US011622844B2

(12) United States Patent
Stroud

(10) Patent No.: US 11,622,844 B2
(45) **Date of Patent: *Apr. 11, 2023**

(54) METHOD, APPARATUS AND KIT FOR ARTIFICIAL INSEMINATION OF BOVINE

(71) Applicant: Brad K. Stroud, Weatherford, TX (US)

(72) Inventor: Brad K. Stroud, Weatherford, TX (US)

(73) Assignee: Maximate, LLC, College Station, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/841,422

(22) Filed: Apr. 6, 2020

(65) Prior Publication Data

US 2020/0246123 A1 Aug. 6, 2020

Related U.S. Application Data

(63) Continuation of application No. 14/683,701, filed on Apr. 10, 2015, now Pat. No. 10,610,343, which is a continuation-in-part of application No. 13/814,458, filed as application No. PCT/US2010/045028 on Aug. 10, 2010, now Pat. No. 9,554,883.

(51) Int. Cl.
*A61D 19/02* (2006.01)

(52) U.S. Cl.
CPC ..... *A61D 19/027* (2013.01); *A61D 19/022* (2013.01)

(58) Field of Classification Search
None
See application file for complete search history.

(56) References Cited

U.S. PATENT DOCUMENTS 2,176,042 A 10/1939 Pittenger
2,566,632 A 9/1951 Propp
(Continued)

FOREIGN PATENT DOCUMENTS

CA 1073286 3/1980
CN 2219683 2/1996
(Continued)

OTHER PUBLICATIONS

U.S. Appl. No. 13/814,458, filed Jul. 3, 2013.
(Continued)

*Primary Examiner* — Kaylee R Wilson
(74) *Attorney, Agent, or Firm* — Craig R. Miles; CR Miles P.C.

(57) ABSTRACT

The present artificial insemination instrument may include a single use, hollow, elongate, metal pipette and a single disposable syringe that is not toxic to bovine sperm. The apparatus is used with any type of diluent that is not toxic to bovine sperm. In various embodiments, a technician may use non-sorted reduced sperm count semen straws from a bull stud, cut an unsorted semen straw into several pieces to use one piece at a time per cow, thaw one straw and mix the non-sorted semen with diluent, or use reduced sperm count semen straws filled with sex sorted semen by the manufacturer. A procedure is disclosed to use the artificial in semination instrument, reduced sperm count semen from any of the aforementioned sources, a non-toxic syringe, and a diluent to achieve conception rates at least as good as conventional prior art device and procedure conception rates.

7 Claims, 6 Drawing Sheets

(56) References Cited

U.S. PATENT DOCUMENTS

| | | | |
|---|---|---|---|
| 2,944,541 | A | 7/1960 | Sacchi et al. |
| 3,256,884 | A | 6/1966 | Hill et al. |
| 3,266,532 | A | 8/1966 | Stewart |
| 3,811,423 | A | 5/1974 | Dickinson, III et al. |
| 3,811,443 | A | 5/1974 | Dickinson, III et al. |
| 3,877,430 | A | 4/1975 | Wieder |
| 3,889,676 | A | 6/1975 | Greene |
| 3,910,275 | A | 10/1975 | Babey et al. |
| 4,301,797 | A | 11/1981 | Pollack |
| 4,305,392 | A | 12/1981 | Chester |
| 4,324,235 | A | 4/1982 | Beran |
| 4,335,723 | A | 6/1982 | Patel |
| 4,411,656 | A | 10/1983 | Cornett |
| 4,419,986 | A | 12/1983 | Leibo |
| 4,457,313 | A | 7/1984 | Alter |
| 4,493,700 | A | 1/1985 | Cassou et al. |
| 4,654,025 | A | 3/1987 | Cassou et al. |
| 4,780,451 | A | 10/1988 | Donaldson |
| 5,030,202 | A | 7/1991 | Harris |
| 5,147,299 | A | 9/1992 | Mendoza et al. |
| 5,147,315 | A | 9/1992 | Weber |
| 5,496,272 | A | 3/1996 | Chung et al. |
| 5,904,665 | A | 5/1999 | Muharib |
| 5,916,144 | A | 6/1999 | Li et al. |
| 5,985,538 | A | 11/1999 | Stachecki |
| 6,071,231 | A | 6/2000 | Mendoza et al. |
| 6,130,034 | A | 10/2000 | Aitken |
| 6,140,121 | A | 10/2000 | Ellington et al. |
| 6,368,786 | B1 | 4/2002 | Saint-Ramon et al. |
| 6,403,631 | B1 | 6/2002 | Sharp et al. |
| 6,454,756 | B1 | 9/2002 | Sasaki |
| 6,454,759 | B2 | 9/2002 | Krulevitch et al. |
| 6,551,236 | B1 | 4/2003 | Liegois |
| 6,569,118 | B2 | 5/2003 | Johnson et al. |
| 7,056,279 | B2 | 6/2006 | Verberckmoes et al. |
| 7,339,090 | B2 | 3/2008 | Christmann |
| 9,554,883 | B2 | 1/2017 | Stroud |
| 10,610,343 | B2 | 4/2020 | Stroud |
| 2002/0038113 | A1 | 3/2002 | Gourley et al. |
| 2002/0072650 | A1 | 6/2002 | Garcia et al. |
| 2003/0008918 | A1 | 1/2003 | Kurogi et al. |
| 2003/0196213 | A1 | 10/2003 | Matthijs-Rijsenbilt et al. |
| 2004/0031071 | A1 | 2/2004 | Morris et al. |
| 2004/0199044 | A1 | 10/2004 | Verberckmoes et al. |
| 2004/0261799 | A1 | 12/2004 | Mock |
| 2005/0051578 | A1 | 3/2005 | Bonham |
| 2005/0064579 | A1 | 3/2005 | Loskutoff et al. |
| 2005/0214733 | A1 | 9/2005 | Graham et al. |
| 2006/0040340 | A1 | 2/2006 | Greene |
| 2006/0079731 | A1 | 4/2006 | Chen |
| 2006/0213374 | A1 | 9/2006 | Shippert |
| 2007/0055094 | A1 | 3/2007 | Chen |
| 2007/0197996 | A1 | 8/2007 | Kraft et al. |
| 2007/0255091 | A1* | 11/2007 | Ainley, Jr. ..... A61D 19/027 600/35 |
| 2009/0023980 | A1 | 1/2009 | Ainley, Jr. |
| 2009/0030268 | A1 | 1/2009 | Stroud |
| 2009/0281371 | A1 | 11/2009 | Stroud |
| 2010/0121135 | A1 | 5/2010 | Oksenberg et al. |
| 2010/0179377 | A1 | 7/2010 | Hagby |
| 2010/0191041 | A1 | 7/2010 | Li et al. |
| 2012/0085779 | A1 | 4/2012 | Stern et al. |
| 2012/0283509 | A1 | 11/2012 | Pfistershammer |
| 2013/0289403 | A1 | 10/2013 | Stroud |

FOREIGN PATENT DOCUMENTS

| | | | |
|---|---|---|---|
| CN | 2525951 | 12/2002 | |
| CN | 200998328 | 1/2008 | |
| CN | 201257008 | 6/2009 | |
| CN | 201414853 | 3/2010 | |
| EP | 0071538 | 9/1983 | |
| EP | 214043 | 3/1987 | |
| EP | 0538786 | 4/1993 | |
| EP | 0685556 | 6/1995 | |
| EP | 1066802 | 1/2001 | |
| FR | 2647668 | 12/1990 | |
| FR | 2720407 | 1/1995 | |
| GB | 867274 | 5/1961 | |
| GB | 1488397 | 10/1977 | |
| GB | 2031456 | 4/1980 | |
| JP | H0199572 | 4/1989 | |
| JP | 2001-017026 | 1/2001 | |
| JP | 2006-198158 | 8/2006 | |
| JP | 2008028635 | 2/2008 | |
| WO | WO 9103935 | 4/1991 | |
| WO | WO 9428810 | 12/1994 | |
| WO | WO 2011063454 | 6/2011 | |
| WO | WO-2012021127 A2 * | 2/2012 | ..... A61D 19/00 |
| WO | WO 2013176047 A1 | 11/2013 | |

OTHER PUBLICATIONS

U.S. Appl. No. 14/683,701, filed Apr. 10, 2015.
U.S. Appl. No. 14/683,701, Office Action dated Apr. 7, 2017.
U.S. Appl. No. 14/683,701, Office Action dated Dec. 5, 2017.
U.S. Appl. No. 14/683,701, Office Action dated Jun. 11, 2018.
U.S. Appl. No. 14/683,701, Office Action dated Mar. 9, 2019.
PCT International Patent Application No. PCT/US10/45028; International Search Report and Written Opinion of the International Searching Authority dated Feb. 22, 2012.
Corresponding Indian Patent Application No. 1100/DELNP/2013, Examination Report dated Jan. 15, 2019, 6 pages.
Corresponding Brazilian Patent Application No. BR 112013002918-8, Office Action dated Jul. 23, 2019, 4 pages.
Amann. Exposure of Thawed Frozen Bull Sperm to a Synthetic Peptide Before Artificial Insemination Increases Fertility. Journal of Andrology, (1999), vol. 20, No. 1, pp. 42-46.
Barth. Factors Affecting Fertility with Artificial Insemination. Vet. Clin. North Am. Food Anim. Pract. (1993), 9(2):275-89.
Berber et al. Comparison of Two Ovsynch Protocols (Gnrh Versus LH) for Fixed Timed Insemination in Buffalo (*Bubalus bubalis*). Theriogenology (2002), 57(5):1421 -30.
Bergqvist et al. Sulphated Glycosaminoglycans (S-GAGs) and Syndecans in the Bovine Oviduct. Animal Reproduction Science 93, (2006), pp. 46-60.
Betieridge. A Historical Look at Embryo Transfer. J. Reprod. Fert., (1981), 62, pp. 1-13.
Block et al. Effect of Addition of Hyaluronan to Embryo Culture Medium on Survival of Bovine Embryos in Vitro Following Vitrification and Establishment of Pregnancy After Transfer to Recipients. Theriogenology, (2009), on-line publication of 9 pages.
Boedeker Plastics. Polyethylene Specifications. Website, http://www.boedeker.com/polye_p.htm; accessed online on Aug. 29, 2017.
Bracken. Fertilization and Early Development of Cow Ova. Biology of Reproduction 23 (1980), pp. 189-205.
Dairy Herd Staff. Reproductive Efficiency = Environmental Efficiency. Dairy Herd Management, (2009).
Dalton et al. Effect of a Deep Uterine Insemination on Spermatozoa! Accessibility to the Ovum in Cattle: A Competitive Insemination Study. Theriogenology (1999), vol. 51, Iss. 5, pp. 883-890.
Dalton. Factors Important to the Efficiency of Artificial Insemination in Single-Ovulating and Superovulated Cattle. Dissertation submitted for degree of Doctor of Philosophy in Animal Science, (1999).
DeJarnette et al. Accessory Sperm: Their Importance To Fertility And Embryo Quality, And Attempts To Alter Their Numbers in Artificially Inseminated Cattle. J. Anim Sci, (1992), 70(2):484-491.
Foote. The History of Artificial Insemination: Selected Notes and Notables. American Society of Animal Science, (2002), pp. 1-10.
Furmus et al. Effect of Hyaluronic Acid on Development of In Vitro Produced Bovine Embryos. Theriogenology (1998), 49(8):1489-1499.
Gao et al. Successful Low Dose Insemination of Flow Cytometrically Sorted Sika (*Cervus nippon*) Sperm in Wapiti (*Cervus elaphus*). Animal Reproduction Science, (2009), 118(1):89-93.

(56) References Cited

OTHER PUBLICATIONS

George et al. Set Up of a Serum-Free Culture System for Bovine Embryos: Embryo Development and Quality Before and After Transient Transfer. Theriogenology 69, (2008), pp. 612-623.
Graves et al. Evaluation of Uterine Body and Bilateral Uterine Hom Insemination Techniques. J. Dairy Sci. (1991), 74(10): 3454-6.
Hartman et al. First Findings of Tubal Ova in the Cow, Together with Notes on Oestrus. The Anatomical Record, 1931, vol. 48, No. 2, pp. 267-275.
Hawk et al. Effect of Unilateral Cornual Insemination upon Fertilization Rate in Superovulating and Single-Ovulating Cattle. J Anim Sci, (1986), 63(2):551-560.
Hawk. Sperm Survival and Transport in the Female Reproductive Tract. J Dairy Sci (1983), 66:2645-2660.
Hawk. Transport and Fate of Spermatozoa After Insemination of Cattle. Journal of Dairy Science, (1987), vol. 70, No. 7, pp. 1487-1503.
Heiskanen et al. Insemination Results with Slow-Cooled Stallion Semen Stored for 70 or 80 Hours. Theriogenology (1994), vol. 42, Iss. 6, pp. 1043-1051.
Hunter et al. Deep Uterine Insemination of Cattle: A Fruitful Way Forward with Smaller Numbers of Spermatozoa. Acta Vet Scand. (1998), 39(2):149-63.
Hunter et al. Sperm Transport in the Cow: Periovulatory Redistribution of Viable Cells Within the Oviduct. Reprod. Nutr Develop., (1984), 24:597-608.
Hunter. Advances in Deep Uterine Insemination: A Fruitful Way Forward to Exploit New Sperm Technologies in Cattle. Anim Reprod Sci., (2003) 79(3-4):157-170.
Januskauskas et al. Relationship Between Sperm Response to Glycosaminoglycans In Vitro and Non-Return Rates of Swedish Dairy A1 Bulls. Reprod Dom Anim, (2000), 35:207-212.
Kurykin et al. Fixed Time Deep Intracomual Insemination of Heifers at Synchronized Estrus. Theriogenology (2003), 60(7):1261-8.
Lopez-Gatius et al. Intraperitoneal Insemination and Retrograde Sperm Transport in Dairy Cows. J. Vet. Med., (2000), 47(2):83-8.
MacPherson. Semen Placement Effects on Fertility in Bovines. J. Dairy Science (1968), vol. 51, No. 5, pp. 807-808.
Mitchell. Distribution and Retention of Spermatozoa with Acrosomal and Nuclear Abnormalities in the Cow Genital Tract. J. Amin. Sci., (1985), 61:956-967.
Munkittrick. Accessory Sperm Numbers for Cattle Inseminated with Protamine Sulfate Microcapsules. J. Dairy Sci. (1992), 75:725-731.
Nebel et al. Microencapsulation of Bovine Spermatozoa. J. Anim Sci (1985), 60(6):1631-1639.
Nebel et al. Microencapsulation of Bovine Spermatozoa for Use in Artificial Insemination: A Review. Reproduction, Fertility and Development (1993), 5(6):701-712.
Nizanski. Intravaginal Insemination of Bitches with Fresh and Frozen-Thawed Semen with Addition of Prostatic Fluid: Use of an Infusion Pipette and the Osiris Catheter. Theriogenology, (2006), 66(2):470-483.
Palasz et al. Effects of Hyaluronan, BSA, and Serum on Bovine Embryo In Vitro Development, Ultrastructure, and Gene Expression Patterns. Molecular Reproduction and Development (2006), 73(12):1503-1511.
Peippo et al. Embryo Production From Superovulated Holstein-Friesian Dairy Heifers And Cows After Insemination With Frozen-Thawed Sex-Sorted X Spermatozoa Or Unsorted Semen. Anim Reprod Sci. (2009), 111(1):80-92.
Pena et al. Effect of Hyaluronan Supplementation on Boar Sperm Motility and Membrane Lipid Architecture Status After Cryopreservation. Theriogenology (2004). 61(1):63-70.
Ranganathan et al. Evidence for Presence of Hyaluronan Binding Protein on Spermatozoa and Its Possible Involvement in Sperm Function. Molecular Reproduction and Development (1994), 38:69-76.
Rodriguez-Martinez. Role of the Oviduct in Sperm Capacitation. Theriogenology, (2007), 68 Suppl 1:S138-46.
Saacke et al. Involvement of the Bull and Inseminate in Fertility and Embryo Quality, AET Convention (1994), pp. 43-55.
Saacke. What Happens to All Those Sperm?: The Interation of Male and Female in Success of Mating. Society for Theriogenology (2004), 10 pages, Lexington, KY.
Salisbury et al. Fertility Level of Bull Semen Diluted at 1:400 With and Without Sulfanilamide. (1948), pp. 817-822.
Salisbury et al. Further Studies of the Effect of Dilution Rate on the Fertility of Bull Semen Used for Artificial Insemination. (1944), pp. 233-241.
Salisbury et al. Preservation of Bovine Spermatozoa in Yolk-Citrate Diluent and Field Results From Its Use. Journal of Dairy Science, (1941), vol. XXIV, No. 11, pp. 905-910.
Salisbury. Fertility of Bull Semen Diluted at 1:100. J. Dairy Sci. (1946), pp. 695-697.
Schenk et al. Effects of Extender and Insemination Dose on Postthaw Quality and Fertility of Bovine Sperm. J Dairy Sci (1987), 70:1458-1464.
Sieme, et al. Effects of Different Artificial Insemination Techniques and Sperm Doses on Fertility of Normal Mares and Mares with Abnormal Reproductive History. Theriogenology, (2004), 62(5):915-928.
Sirard et al. In Vivo and In Vitro Effects of FSH on Oocyte Maturation and Developmental Competence. Theriogenology 68S (2007) S71-S76.
Suarez. Interactions of Spermatozoa with the Female Reproductive Tract: Inspiration for Assisted Reproduction. Reproduction, Fertility and Development, (2007), 19, 103-110.
Talbot et al. Cell Adhesion and Fertilization: Steps in Oocyte Transport, Sperm-Zona Pellucida Interactions, and Sperm-Egg Fusion. Biology of Reproduction (2003), 68:1-9.
Tanabe. The Nature of Reproductive Failure in Cows of Low Fertility. Wisconsin Agricultural Experiment Station, (1948), Paper No. 383, pp. 237-246.
Tanghe et al. Cumulus Contributions During Bovine Fertilization In Vitro, Theriogenology 60, (2003), pp. 135-149.
Testing Committee Report. Abstracts of Papers Presented at the Thirty-Seventh Annual Meeting, (1942), pp. 667-731.
Van Soom et al. Deep Intrauterine Insemination in Cattle. Gynecologie, Obstetrique & Fertilite, (2004), 32(10):911-5.
Vandemark. Sperm Transport in the Perfused Genital Tract of the Cow. Am. J. Physiol (1955), 183:510-512.
Verberckmoes et al. Assessment of a New Utero-Tubal Junction Insemination Device in Dairy Cattle. Theriogenology, (2004), vol. 61, Iss. 1, pp. 103-115.
Verberckmoes et al. Low Dose Insemination in Cattle with the Ghent Device, Theriogenology, (2005), vol. 64, Iss. 8, pp. 1716-1728.
Verberckmoes. Preservation of Fresh Bovine Semen and Utero-Tubal Junction Insemination in Cattle; de Faculteit Diergeneeskunde, Universiteit Gent (2004), Thesis.
Weeth et al. Comparative Efficiency of Intracervical and Intra-Uterine Methods of Insemination in Dairy Cattle. Dept. of Dairy Husbandry, Missouri Agricultural Experiment Station Journal, (1950), Series No. 1224, pp. 195-198.
Wilmut et al. Sperm Transport into the Oviducts of Heifers Mated Early in Oestrus. Reprod. Nutr. Develop., (1984), 24(4), pp. 461-468.

* cited by examiner

METHOD, APPARATUS AND KIT FOR ARTIFICIAL INSEMINATION OF BOVINE

CROSS-REFERENCE TO RELATED APPLICATIONS

This United States Patent Application is a continuation of U.S. patent application Ser. No. 14/683,701, filed Apr. 10, 2015, now U.S. Pat. No. 10,610,343, issued Apr. 7, 2020, which is a continuation-in-part of U.S. patent application Ser. No. 13/814,458, filed Jul. 3, 2013, now U.S. Pat. No. 9,554,883, issued Jan. 31, 2017, each hereby incorporated by reference herein.

SUMMARY OF THE INVENTION

A particular embodiment of the present invention includes an artificial insemination instrument which may include a single use, hollow, elongate, metal pipette and a single disposable syringe that is not toxic to bovine sperm. The apparatus is used with any type of diluent that is not toxic to bovine sperm. In various embodiments, a technician may use non-sorted reduced sperm count semen straws from a bull stud, cut an unsorted semen straw into several pieces to use one piece at a time per cow, thaw one straw and mix the non-sorted semen with diluent, or use reduced sperm count semen straws filled with sex sorted semen by the manufacturer. A procedure is disclosed to use the artificial insemination instrument, reduced sperm count semen from any of the aforementioned sources, a non-toxic syringe, and a diluent to achieve conception rates at least as good as conventional prior art device and procedure conception rates.

Another particular embodiment of the present invention includes a method, apparatus and a kit for artificially inseminating bovine wherein the apparatus includes three or four physical components, namely, a (1) bellows-like container, (2) a nozzle for coupling to the bellows-like container (the nozzle could be integrally formed with the bellows-like container), (3) a stainless steel pipette, and (4) a flexible tubing for coupling the stainless steel pipette to the nozzle of the bellows-like container.

More particularly, the first component of a particular embodiment of the present apparatus is a non-toxic low density polyethylene (LDPE) bellows-like container that preferably holds 30 ML of fluid and/or air. Compared to a syringe, most of which are toxic to bovine sperm, the present bellows-like container is virtually non-toxic to bovine sperm making it suitable for storage after filling as will be hereinafter further explained. The present bellows container is significantly shorter (2.5 inches long) when filled than a filled syringe (8 inches long) which makes it easier to handle for the technician during breeding. Also, due to the ribs associated with the bellows-like container, there is more surface area which makes it faster to warm up than a straight walled syringe. The soft low density polyethylene (LDPE) makes it very easy to push and evacuate the contents from the bellows vessel when inseminating. One end portion of the bellows container includes a cavity or opening adapted for coupling to the second component of the present apparatus, namely, the nozzle.

The second component of a particular embodiment of the present apparatus includes a nozzle made of a hard plastic such as a medium density polyethylene material (MOPE) having one end portion that is configured to cooperatively engage or snap into the female cavity associated with the bellows-like container. The nozzle also includes a cap that engages the distal end of the nozzle for preventing spilling of any contents stored within the bellows-like container during shipment or storage. The cap can be engaged to the nozzle using any known means such as a snap-on, friction or threaded engagement. The present nozzle has an internal lumen or inner diameter that accommodates both half and quarter ML semen straws. The bottom or proximal end of the nozzle may include an optional grate or stop member that acts as a stop so that a thawed semen straw cannot come into contact with any diluent contained in the bellows container. Once semen is placed into the bellows container with a diluent, the nozzle then easily slides into the proximal end of a flexible tube which is attached thereto as will be hereinafter explained.

The third component of a particular embodiment of the present apparatus includes a stainless steel pipette having a much smaller outer diameter as compared to conventional or standard insemination pipettes used in the AI industry thereby giving the breeder a much needed advantage with respect to passing the stainless steel pipette through the tortuous and difficult-to-navigate cervix of some female bovines, especially young heifers of all breeds, mature cows of breeds composed of *Bos Indicus* genetics, and some mature cows of all breeds including dairy cows. The present pipette has a smooth rounded terminal end portion for better penetrating the cervix of a female bovine and at least one transverse outlet port for allowing the semen/diluent to exit the pipette into the reproductive organs of the female bovine. The advantages of the metal pipette, rounded terminal end portion and transverse outlet port will be hereinafter further explained.

The fourth component of a particular embodiment of the present apparatus includes a flexible silicone tubing which may come pre-attached to the stainless steel pipette and autoclaved. A secure attachment of the silicone tubing to both the nozzle member and the stainless steel pipette is essential. The properties and physical dimensions of the silicone tubing allows for easy connection to both the nozzle member and the metal pipette and it provides for a secured attachment thereto once in place. To assist in the attachment to the metal pipette, the proximal end of the stainless steel pipette may include an added brass or plastic collet, or one or more raised projections or ridges, over which the silicone tubing is stretched, the collet or projection(s) or ridge(s) facilitating holding of the flexible tube tightly in place on the stainless steel pipette. The opposite end of the flexible tubing is attached to the terminal end portion of the nozzle when the overall apparatus is ready for use as will be hereinafter further explained.

It is recognized and anticipated that the present nozzle of a particular embodiment of the present apparatus can be integrally formed with the bellows-like container and it is further contemplated that the optional stop member associated with the present nozzle can likewise be located within the female cavity of the bellows-like container.

The method for using a particular embodiment of the present apparatus includes providing a diluent within the bellows-like container and thereafter inserting a semen straw into the present nozzle for incorporating and mixing the semen associated with the semen straw with the diluent present in the bellows-like container. Once the semen has been properly mixed with the diluent in the bellows-like container, the flexible tubing is coupled to both the distal end of the present nozzle and the proximal end of the stainless steel pipette. At this point, the present apparatus is ready for insertion into a female bovine. Once the stainless steel pipette is properly inserted through the cervix of the female bovine, the bellows-like container is then rotated to an elevated position relative to the pipette as will be hereinafter further explained. This elevated positioning of the bellows-like container helps to clear the pipette of the semen/diluent mix and substantially reduces the amount of residual semen left in the pipette after the insemination process is complete as will likewise be hereinafter further explained. Use of the flexible tubing between the present nozzle and the stainless steel pipette enables rotation of the bellows-like container to its elevated, vertical positioning as just described.

Still further, it is anticipated that a particular embodiment of the present apparatus can be provided in kit form wherein a diluent is pre-loaded into the bellows-like container and a cap is positioned on the present nozzle which is coupled to the bellows-like container so as to contain the diluent within the bellows-like container during shipment and storage. The kit will also include a stainless steel pipette as will be hereinafter further explained along with the flexible tubing. One end portion of the flexible tubing can be pre-attached to the proximal end of the stainless steel pipette and, once the semen from a semen straw has been mixed with the diluent contained within the bellows-like container, the opposite end portion of the flexible tubing can be coupled to the terminal end portion of the present nozzle thereby completing the assembly of the present apparatus. Once assembled, a particular embodiment of the present apparatus is ready for use in artificially inseminating a female bovine as will be hereinafter further explained.

DETAILED DESCRIPTION OF THE INVENTION

Figure 1:
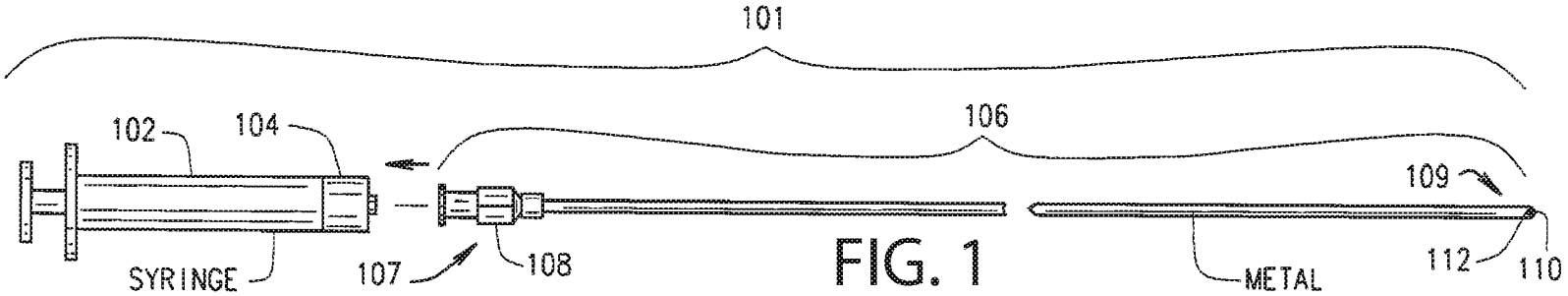
FIG. 1 is a perspective view of a particular embodiment of the present invention. This device is inserted into the female using rectal palpation techniques. In this figure the disposable, non-toxic syringe is not connected to the hollow, elongate, metal pipette.

FIG. 1 is a perspective view of a particular embodiment of an AI instrument of the present invention generally identified by the numeral 101. The instrument 101 is inserted into the bovine using rectal palpation techniques well known to those skilled in the art. In this figure, the disposable, non-toxic syringe 102 is disconnected from the hollow, elongate, metal pipette 106. The syringe has a luer lock 104 formed on the distal end, or some other form of luer connector. The hollow, elongate metal pipette has a proximal end 107 which may be formed into a luer hub 108 or some other type of luer connector. The distal end of the pipette 109 may be formed into a generally rounded tip 110. At least one outlet port 112 is formed proximal the tip 110. As to particular embodiments, the outer diameter of the pipette 109 can be approximately 0.134 inches. The luer lock 104 and the luer hub 108 may be disconnected as shown in this figure or connected as shown in the next figure.

Figure 2:
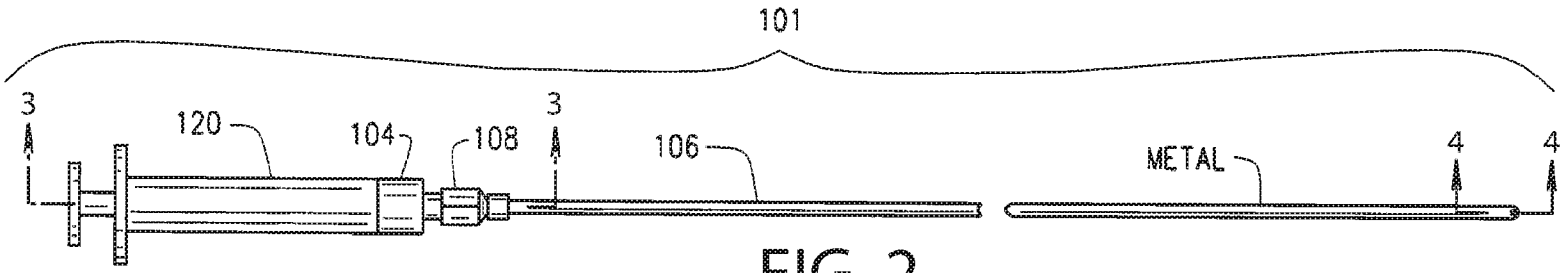
FIG. 2 is a perspective view of FIG. 1 wherein the non-toxic syringe has been connected to the hollow, elongate, metal pipette.

FIG. 2 is a perspective view of FIG. 1 wherein the disposable, non-toxic syringe 102 is connected to the hollow, elongate, metal pipette 106. The luer hub 108 or some other type of luer connector on the pipette 106 is inserted into the luer lock 104 or some other type of mating luer connector on the syringe 102 and these components are gently rotated in opposite directions until they lock together and form a seal. The design and shape of the luer hub and the luer lock are known.

Figure 3:
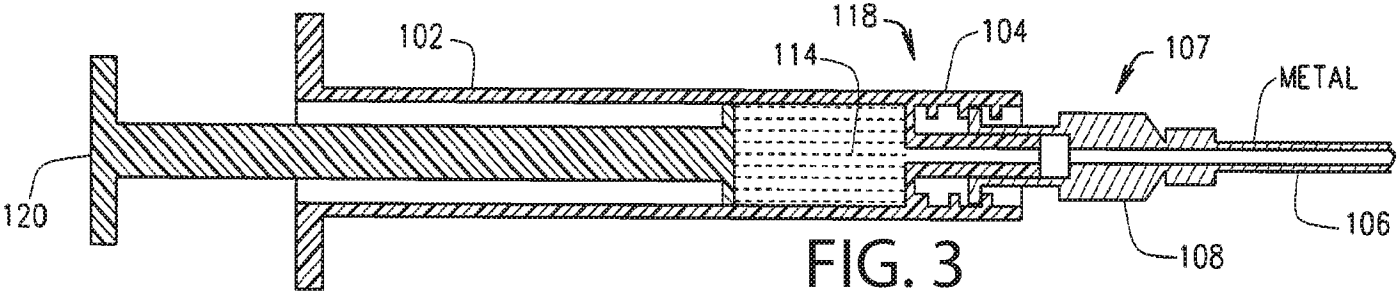
FIG. 3 is an enlarged cross-section drawing along the line 3-3 of FIG. 2 showing the disposable, non-toxic syringe of the present invention connected to the proximal end of the hollow, elongate, metal pipette.

FIG. 3 is a cross-section drawing along the line 3-3 of FIG. 2 of the disposable, non-toxic syringe 102 of the present invention connected to the proximal end 107 of the hollow, elongate, metal pipette 106. In this figure, diluent and semen have been aspirated into the disposable, non-toxic syringe, forming an insemination solution 114. When the syringe plunger 120 is pushed by the Bovine AI Technician, the insemination fluid flows from the syringe, through the hollow, elongate metal pipette and out the at least one outlet port into the bovine.

Figure 4:
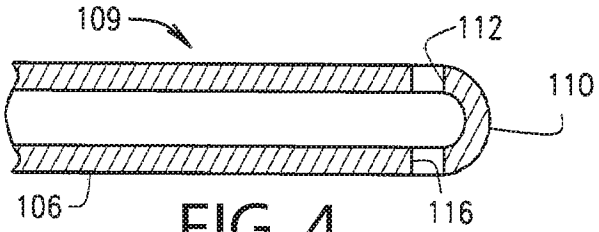
FIG. 4 is an enlarged cross-section drawing along the line 4-4 of FIG. 2 showing the distal end of the hollow, elongate, metal pipette.

FIG. 4 is a cross-section enlargement along the line 4-4 of FIG. 2 of the distal end 109 of the hollow, elongate metal pipette 106. In this embodiment, the tip 110 is rounded and has two transverse outlet ports, 112 and 116, respectively. These outlet ports allow an insemination solution to flow from the syringe, through the hollow, elongate metal pipette 106, out the two opposing transverse outlet ports and into the bovine.

Referring now to FIGS. 1, 2, 3 and 4, the luer hub 108 or some other type of luer connector, on the pipette 106 and the luer lock 104 or some other type of mating luer connector on the syringe 102 are a means to achieve a fluid tight connection between the distal end 118 of the single, disposable non-toxic syringe 102 and the proximal end 107 of the hollow, elongate metal pipette 106 to allow the insemination solution 114 in the syringe 102 to flow from the single, disposable non-toxic syringe 106 through the hollow, elongate metal pipette 106 and out the at least one outlet port 112 into the female's uterus.

Figure 5:
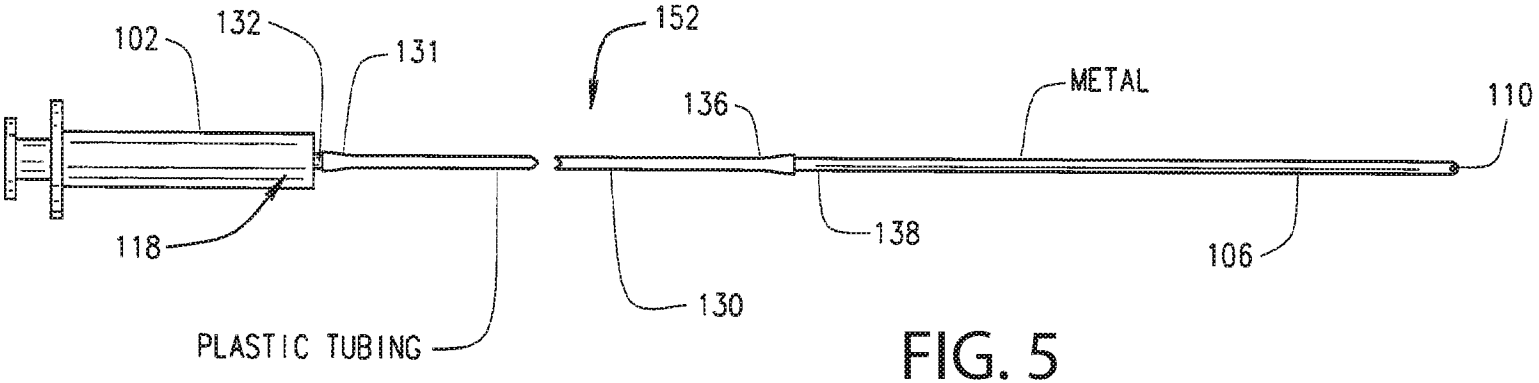
FIG. 5 is a perspective view of an alternative embodiment of the hollow, elongate, metal pipette connected to the disposable, non-toxic syringe by flexible tubing.

FIG. 5 is a perspective view of an alternative embodiment 152 of the hollow, elongate, metal pipette 106 connected to the disposable, non-toxic syringe 102 by flexible tubing 130. The tubing may be formed from any number of elastomers, provided that they are non-toxic to bovine sperm. In this embodiment, a luer slip 132 or some other type of luer connector is formed on the distal end 118 of the disposable, non-toxic syringe 102. The proximal end 131 of the tubing 130 is sized and arranged to fit over and seal against the luer slip 132, as shown. The distal end 136 of the tubing is sized and arranged to fit over and seal against the proximal end 138 of the pipette 106. The proximal end 138 of the pipette does not have a luer hub. Rather, it is a hollow tube of generally constant diameter from the proximal end 138 to the tip 110. The insemination solution flows from the disposable non-toxic syringe, through the non-toxic tubing, through the metal pipette and out the at least one outlet port.

The luer slip 132 or some other type of luer connector on the syringe 102, the proximal end 131 of the flexible tubing 130, the distal end 136 of the flexible tubing 130 and the proximal end 138 of the pipette 106 are a means to achieve a fluid tight connection between the distal end of the single, disposable non-toxic syringe 102 and the proximal end 138 of the hollow, elongate metal pipette 106 to allow the insemination solution 114 in the syringe 102 to flow from the single, disposable non-toxic syringe 102 through the hollow, elongate metal pipette 106 and out the at least one outlet port 112 into the female's uterus.

Figure 6:
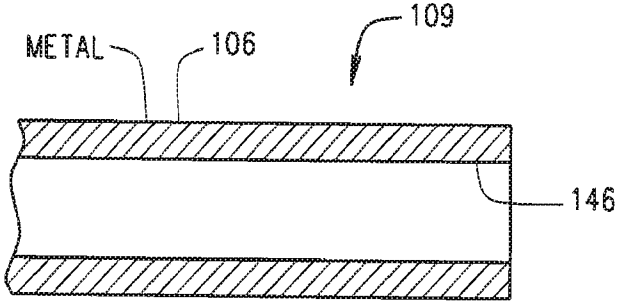
FIG. 6 is a sectional view of an alternative embodiment of the distal end of the hollow, elongate, metal pipette.

FIG. 6 is an enlarged section view of an alternative embodiment of the distal end 109 of the hollow, elongate, metal pipette 106. In this embodiment, the distal end 109 of the pipette 106 is formed into an open bore 146. This alternative embodiment is not preferred, as it may entrap debris while passing through the bovine vagina and for other reasons.

Figure 7:
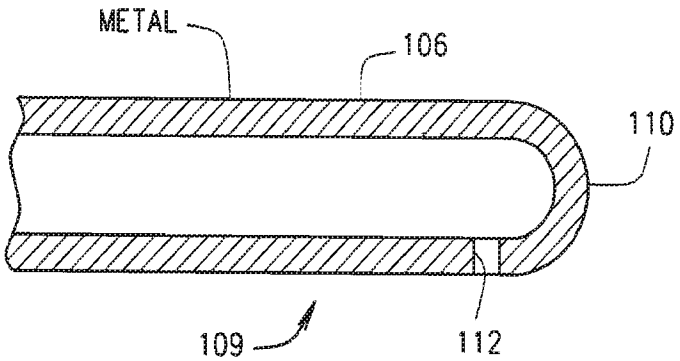
FIG. 7 is another alternative embodiment of the distal end of the hollow, elongate, metal pipette.

FIG. 7 is another alternative embodiment of the distal end 109 of the hollow, elongate, metal pipette 106. In this embodiment, the tip 110 is formed into a smooth rounded shape to facilitate easy passage through the bovine. At least one transverse outlet port 112 is formed proximate to the tip 110.

Figure 8:
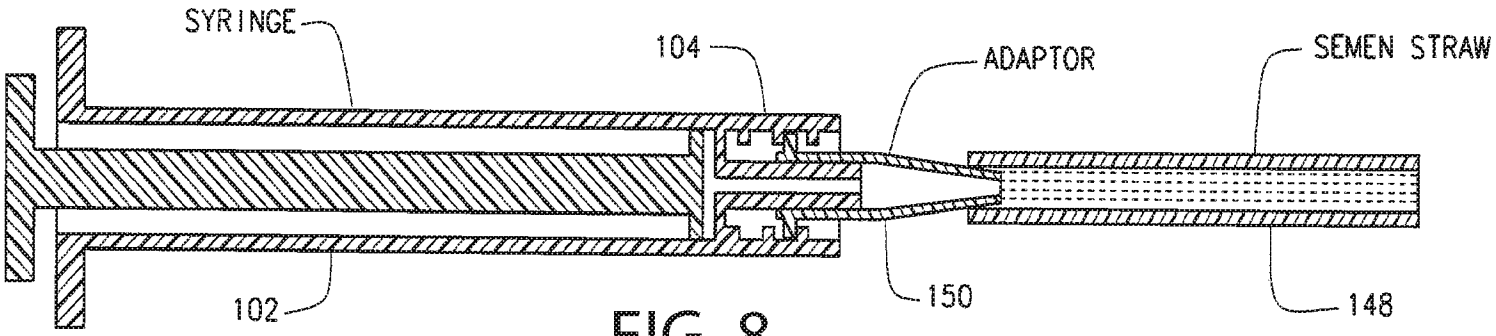
FIG. 8 is a cross-section of an adapter and ½ cc semen straw connected to the disposable, non-toxic syringe used to aspirate the semen from the semen straw.

FIG. 8 is a cross-section of an adapter 150 and ¼ cc semen straw 148 connected to the disposable, non-toxic syringe 102. The purpose of the adapter is to facilitate aspiration of the semen from the semen straw 148 into the disposable, non-toxic syringe 102. The disposable, non-toxic syringe, the adapter and the elongate hollow, metal pipette may be packaged and sold as a kit to Bovine AI Technicians, dairies and others. The present invention, in various embodiments may be packaged in a kit. For example, the components of the apparatus in FIG. 5 may be sold as a kit. In another example, the components shown in FIG. 2 may be sold as a kit. Arrangements of various components from various embodiments may be sold as a kit.

The present invention may be practiced in at least five different ways. Some, but not all of the embodiments disclosed herein include as an option an ovulation examination prior to insemination. Using ultrasound technology the ovulating ovary can be identified prior to insemination. After the ultrasound, using the present invention, the insemination solution may be pumped from the syringe through the hollow, elongate, metal pipette into only one uterine horn, e.g. the horn that will act as a conduit for sperm to fertilize the egg. If this ultrasound procedure is used, the tip of the hollow, elongate, metal pipette must be inserted past the body of the uterus and into the appropriate uterine horn that acts as a conduit to transport sperm to the ovulated egg, thereby concentrating most of the sperm into the ovulating horn. Instead of an ultrasound examination, the vet or other technician may manually palpate the ovaries to determine which will ovulate. After this manual ovulation examination, most of the diluent and sperm are injected into the horn that acts as a conduit to transport sperm to the ovulated egg achieving at least conventional conception rates. (Both the ultrasound evaluation and the manual palpation to determine ovulation are sometimes referred to herein as an "Ovulation Examination"). The first way to practice the present invention is for the Bull Stud to harvest semen from a desirable bull as described below.

A. The Bull Stud

The Bull Stud reduces the sperm count in each straw to less than 20 million sperm. For example, each reduced sperm count semen straw could have approximately 15 million sperm or less. These reduced sperm count semen straws are then frozen in a conventional manner; well know to those skilled in the art. These reduced sperm count semen straws are sold by the Bull Studs to dairy farms and others.

At a large dairy, a hundred female bovines or more may be artificially inseminated on a given day by a trained Bovine AI Technician. "Room Temperature" for this procedure or method is defined as between about 68° to about 80° F. and optimally about 74° F. In a facility that is at Room Temperature, the Technician lays out at least one multi-dose bag of diluent, some disposable non-toxic syringes and some hollow, elongate metal pipettes.

1. Non-Toxic Disposable Syringes

The inventors initially thought that any syringe would be suitable for use in this invention. However, experimental testing proved otherwise. Some syringes are produced with elastomers and/or lubricants that are harmful to sperm. Some syringes that are not harmful to sperm as originally produced may become harmful by being stored in a hot warehouse above about 95° F. Applicant has determined that syringes that are toxic to sperm are not suitable for use in this invention with reduced sperm count semen straws. Applicant recommends use of Norm-Ject® disposable syringes available from Air-Tite Products Co., Inc. located in Virginia Beach, Va., if and only if they have not been stored in a hot warehouse. Applicant recommends using current year production syringes that are as fresh as possible from this manufacturer. Other non-toxic syringes may be purchased from Henke, Sass, Wolf of America, Inc. (www.hswoa.com) in Dudley, Mass. a subsidiary of Henke, Sass, Wolf, GmbH of Tuttlingen, Germany (www.henkesasswolf.de). Specifically the HSW Norm-Ject® disposable syringe may also be suitable for use in the practice of this invention, if and only if they have not been stored in a hot warehouse. (Other syringes, unknown to applicant, may also be suitable for use in this invention, provided that they are non-toxic to bovine sperm.)

Air-Tite represents on its website (www.air-tite-shop.com) that the Norm-Ject disposable syringe is latex free, contains no rubber, no silicone oil, styrene or DEHP and are DNA free. The website further states: "These syringes are the choice for any situation needing an inert, non-reactive syringe. Because of their composition these Norm-Ject® disposable syringes are indicated for nuclear medicine, amniocentisis, IVF, embryo-transfer, chromatography and many laboratory procedures. They are more chemically resistant than rubber tipped syringes and are manufactured only from laboratory grade polypropylene and polyethylene." It is important to note that bovine artificial insemination is not one of the uses mentioned by the manufacturer, as of Aug. 9, 2010, in this website description of its product. The term "non-toxic syringe" as used herein means a disposable Norm-Ject® disposable syringe, a HSW Norm-Ject® disposable syringe and or any other syringe that is latex free, contains no rubber, no silicone oil, styrene, DEHP and is DNA free.

The term "single, disposable, non-toxic syringe" means any of the non-toxic syringes discussed above that a) contain a dose of insemination solution for a single bovine, and/or b) a larger non-toxic syringe that contains multiple does of insemination solution for multiple cows. An automatic syringe, including, draw off syringes and/or self filling syringes such as those from Allflex USA, Inc. located at the DFW Airport in Texas (see www.allflexusa.com) may be used but are not recommend because of contamination concerns. A repeating syringe, such as those also available from Allflex mentioned above, may be used, but is not recommended because of contamination concerns.

2. Diluent

The Bovine AI Technician may select any of several know diluents for use in this procedure including: buffered saline, various commercially available embryo flush solutions, various commercially available extenders used in cryopreversation of semen and other products or other solutions not identified herein may also prove useful provided they have a proper pH, osmolarity and are properly buffered to dilute and support the life of the sperm. The pH of the diluent is typically about 7 to about 7.4 and the osmolarity is typically about 280 to about 300 mOsm/L.

Various commercially available embryo flush solutions that may be suitable in the practice of this invention including:

a) Syngro Holding Medium, Vigro Complete Flush Solution, Vigro Holding Plus, Vigro Rinsing Solution all available from Bioniche Animal Health of Belleville, Ontario, Canada, (www.bionicheanimalhealtyh.com).

b) emP3 Complete Flush and emP3 Holding Solution both available from Partnar Animal Health of Port Huron, Mich., (www.partnaranimalhealth.com).

c) Emcare Complete Ultra Flush Medium, available from ICPbio International Ltd. Of Auckland, New Zealand, (www.icpbio.com).

Some extenders used in cryopreservation of bull semen may be used as a diluent in the practice of this invention and others may not. The term semen extender and semen diluent are sometimes used interchangeably in the industry.

Triladyl, an extender used in cryopreservation of bull semen is not a suitable diluent for use in the practice of this invention because it also contains the cryoprotectant glycerol which is toxic at some concentrations to sperm at temperatures that support cell function. The semen extender disclosed in U.S. Pat. No. 6,368,786 (assigned to IMV Technologies) also contains glycerol which means that it is likewise not suitable for use in this invention. Other semen extenders such as Biladyl®, Fraction A, also from Minitube of America in Verona, Wis. (www.minitube.com) does not contain a cryoprotectant or glycerol and may be suitable for use in the practice of this invention. The present invention may be practiced with any diluent that is not toxic to bovine sperm or the cow's reproductive system.

The diluent may be contained in disposable plastic bags such as those found in hospitals holding Ringer's solution, etc. The reduced sperm count semen straws are kept frozen under liquid nitrogen in a Dewar flask until ready to use. (Bull Studs in the U.S. use ½ cc semen straws that are crimped on one end with a cotton plug on the other end. The semen is in between the crimped end and the cotton plug on the other end.)

It is best to wait until the diluent reaches Room Temperature before proceeding. In the alternative, the Bovine AI Technician may keep the bags of diluent in a storage device which holds the diluent at Room Temperature, to expedite the process. Once the diluent has reached Room Temperature, the Technician fills one of the disposable syringes with the diluent. In the U.S., an adapter is then connected to the luer hub on the syringe. The Technician warms a reduced sperm count frozen straw of semen in warm water at a temperature of about 95° F. to about 98° F. for at least about 15 seconds. Once the semen is thawed, the crimped tip of the reduced sperm count semen straw is cut with a pair of scissors and the cut end is placed over the adapter. The syringe, adapter and reduced sperm count semen straw are held vertically with the cotton plug farthest away from the earth. Then the cotton plug is cut off the straw, which allows the semen to drain by gravity into the diluent in the syringe or in the alternative the semen may be aspirated from the semen straw into the diluent in the syringe. The adapter and the used semen straw are removed from the syringe.

An elongate, metal, single use pipette is connected to the luer hub on the syringe. Applicant recommends that that the elongate, metal, single use pipette be sterile, but this is not essential to the practice of the invention. The distal end of the pipette is inserted by the Technician into the cow's vagina, past the three rings of the cervix to the body of the uterus, using rectal palpation. The Bovine AI Technician then pushes the plunger of the disposable syringe which pumps the diluent and the semen out of the syringe, through the single use elongate metal pipette and into the body of the uterus. The syringe is disposed of and the single use metal pipette may be destroyed or it may be sterilized and reused, provided it is kept in a sterile condition until the next use. If the price of the metal pipette is low enough, it is likely that the metal pipettes will be discarded for recycling.

The bovine reproductive tract, from posterior to anterior, has a vagina, a cervix, a uterine body, two uterine horns, two fallopian tubes, and two ovaries. During a prior art AI procedure the contents of a single straw containing about 20 million non-sorted sperm is placed through the vagina, through the cervix and into the uterine body, which is in fluid communication with both uterine horns. Approximately half of the sperm are naturally shunted to the left uterine horn and half to the right. Sperm that naturally shunts to the left horn has a chance to fertilize an ovum if it is released from the left ovary. Sperm naturally shunted to the right horn has a chance to fertilize an ovum if it is released from the right ovary. Only one ovary releases an egg during each heat cycle.

B. The Snip Technique

A second way to practice the present invention is using the "snip technique" using a conventional semen straw with a) about 20 million unsorted sperm in each straw or b) with a sex sorted straw. First the Bovine Technician pours a small bath of liquid nitrogen. Next a frozen semen straw is removed from a Dewar flask and is placed in the small bath of liquid nitrogen. While under the nitrogen bath, the Bovine AI Technician cuts off a piece of the frozen straw, thus mechanically reducing the sperm count in the piece that has been cut off from the main body of the straw. The frozen portion that has been cut off is then placed in a sterile test tube filled with diluent, at about 95° F. to about 98° F. The balance of the straw that is still in the small bath of liquid nitrogen is removed and quickly placed back in the Dewar flask. After about 15 to about 30 seconds, the semen has been thawed and released into the insemination solution with the diluent in the test tube. The Bovine AI Technician then aspirates the insemination solution from the test tube into the single, disposable non-toxic syringe, to which additional diluent may be added, at the discretion of the Bovine AI Technician. In the alternative, the Bovine AI Technician can draw a larger aliquot of diluent into the syringe from a multi-dose bag and then aspirate the insemination solution from the test tube, containing the thawed semen with a reduced sperm count.

In this fashion, the "snip technique" uses a reduced number of sperm, while at least maintaining comparable conception rates to conventional AI procedures using approximately 20 million sperm per cow in the case of non-sex sorted semen. Again, the type of diluent and the amount of diluent are left to the discretion of the Bovine AI Technician. This embodiment may include as an option an Ovulation Examination prior to insemination, as discussed herein.

C. Sex Sorted Semen

A third way to practice the present invention is with sex sorted semen straws having a reduced sperm count. Semen is sorted by sex, in the case of dairy cattle to produce more female offspring which are much more valuable for milk production.

Each sex sorted semen straw contains a fraction of the amount of semen found in a conventional non-sorted semen straw, as previously discussed. As of the filing dated of this application, most sex sorted semen straws have about 2.1 million sperm each. Sex sorted semen straws with a reduced sperm count will have even less sperm than these conventionally packaged straws. Sex sorted semen straws are packaged in ¼ cc straws and are used in the U.S. and around the world. Sex sorted semen is available from Sexing Technologies of Navasota, Tex., and some but not all Bull Studs. This embodiment may include as an option, an Ovulation Examination prior to insemination, as discussed herein.

D. Single Straw Dilution

A fourth way to use reduced sperm count semen is for a Bovine AI Technician to thaw a single straw of semen, mix with diluent, and concurrently inseminate two or more females. A single straw of semen is warmed and mixed with diluent to form an insemination solution. This solution is then drawn into the AI instrument of the present invention. Then, two or more females are inseminated with portions of this insemination solution. This "Single Straw Dilution Technique" may be used with unsorted semen and with sorted semen. This embodiment may include as an option an Ovulation Examination prior to insemination, as discussed herein.

E. Ovulation Examination Prior to Insemination with Semen Having a Conventional Sperm Count All of the embodiments previously discussed have used reduced sperm count semen to achieve at least conventional conception rates. This embodiment departs from the foregoing because an ovulation examination is conducted on every female prior to insemination with semen having a conventional sperm count to achieve increased conception rates. This embodiment may be used with sex-sorted semen and non-sorted semen. As of the filing date of this application, most sex sorted semen is packaged in a ¼ cc straw with about 2.1 million sperm per straw. As of the filing date of this application, most unsorted semen in the U.S. is packaged in a ½ cc straw with about 20 million sperm; outside the U.S. unsorted semen is packaged in a ¼ cc straw with about 20 million sperm. These conventional sperm counts are used in this embodiment.

Prior to insemination, the Bovine AI Technician and/or a vet or other qualified person conducts an examination of the female to determine which ovary will produce the egg. This Ovulation Examination of the ovaries could be conducted by ultrasound or the examination could be conducted by manual rectal palpation of the ovaries.

After the ovulation examination, semen with at least a conventional sperm count is contacted with a diluent to form an insemination solution. Again, the type of diluent and the volume are left to the discretion of the Bovine AI Technician. The insemination solution is positioned in a single, disposable, non-toxic syringe. Fluid communication is established between the single, disposable, non-toxic syringe and a hollow, elongate, metal pipette as shown in FIG. 2 or FIG. 5 or by some other means. The hollow, elongate, metal pipette is guided using rectal palpation techniques through the female's vagina, cervix, and uterus and into the uterine horn that will act as a conduit to transport sperm to fertilize the egg, as previously determined by the ovulation examination. Proper placement of the pipette in the correct uterine horn is accomplished without an illuminated speculum or a balloon catheter. Use of this procedure should result in increased conception rates when compared with conventional conception rates, discussed herein. To further improve the chances of fertilization, this technique may be used with two semen straws having a conventional sperm count. This two straw approach may be beneficial for some cows.

As of the filing date of this patent application, sex sorted semen is only recommended for use in dairy and beef heifers. Dairy cows are difficult to get pregnant with a non-sorted straw containing 20 million sperm; therefore, use of 2.1 million sorted sperm is problematic. For this reason, producers of sex sorted semen currently do not recommend use of sorted semen in dairy cows.

Conducting an ovulation examination of dairy and beef cows, prior to insemination should allow sex sorted semen to be used successfully on a wide commercial basis for the first time in history, provided that substantially all of the diluent and sorted semen is delivered to the uterine horn that will act as a conduit to transport sperm to fertilize the egg, using the teachings of this invention. Use of sex sorted semen in dairy cows is an important breakthrough because here are many, many more cows in the dairy and beef herds than heifers. This breakthrough effectively allows producers of sex sorted semen into a huge new market which could allow revenues to skyrocket. (Sex sorted semen is typically used on a limited commercial basis because it is used primarily on dairy and beef heifers which are a small part of the larger herd.)

Figure 9:
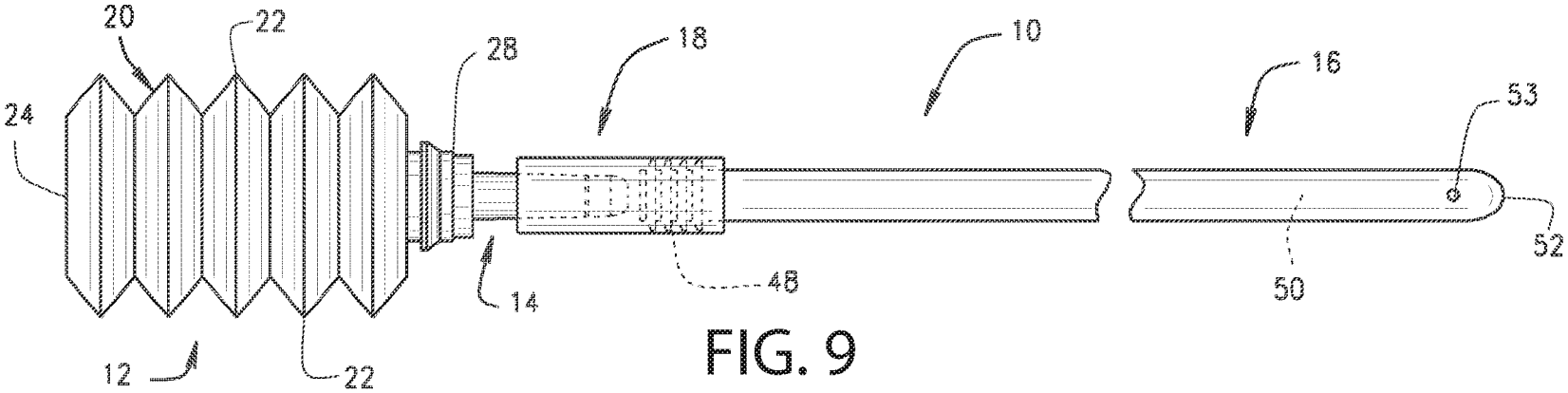
FIG. 9 is a side elevational view of a particular embodiment of the present apparatus for artificially inseminating a female bovine with all of its component parts fully assembled.
Figure 10:
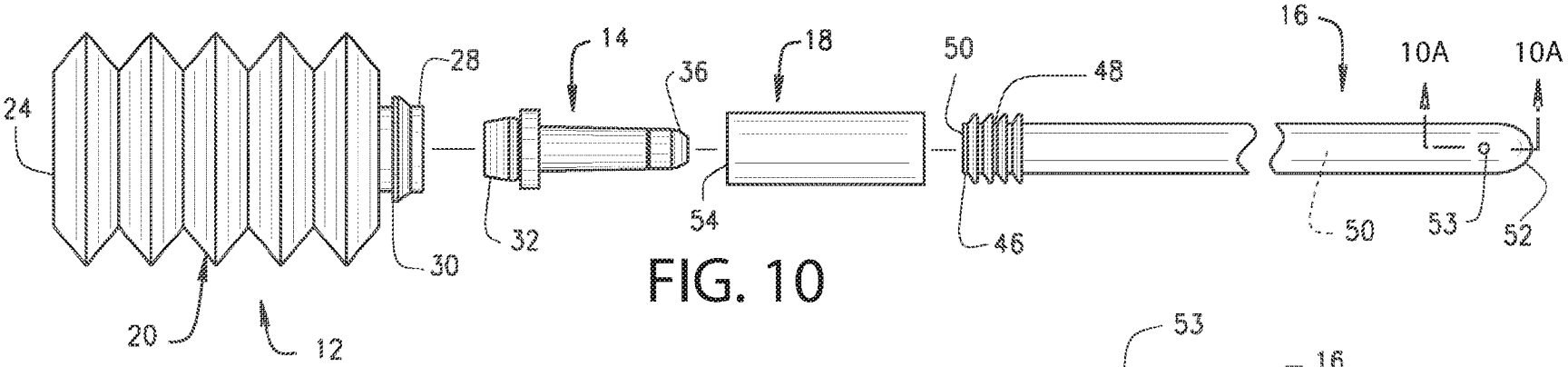
FIG. 10 is a side elevational exploded view of the apparatus of FIG. 9 showing all of its component parts prior to assembly.
Figure 10A:
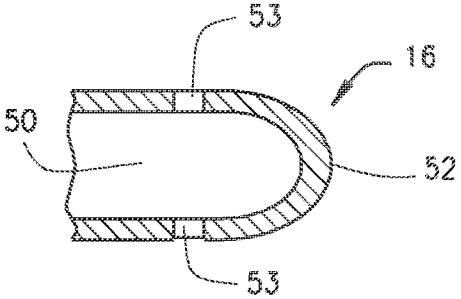
FIG. 10A is an enlarged cross-sectional view of the terminal end portion of the present pipette taken along line 10A-10A of FIG. 10.

FIGS. 9 and 10 disclose another embodiment of the present AI apparatus 10 which includes a bellows-like container 12, a nozzle 14, a stainless steel pipette 16, and a flexible connection tube 18 for operatively connecting the nozzle 14 to the pipette 16. FIG. 9 illustrates the present apparatus 10 in its fully assembled operative condition whereas FIG. 10 illustrates an exploded view of the various components forming the present apparatus 10.

Figure 11:
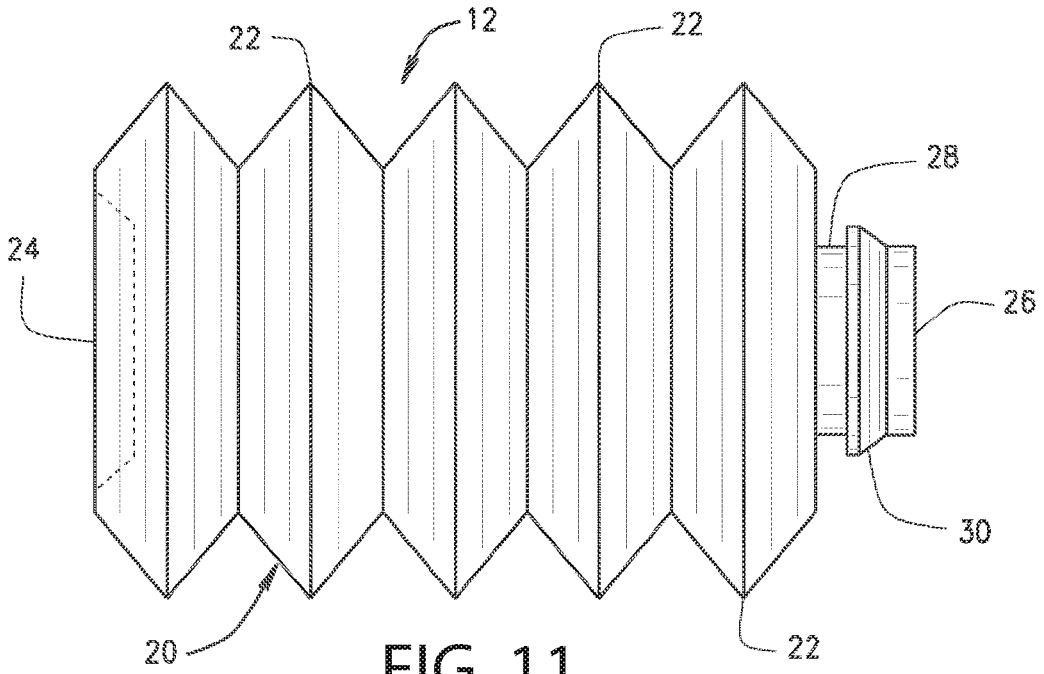
FIG. 11 is a side elevational view of one embodiment of the present bellows-like container of FIGS. 9 and 10.
Figure 12:
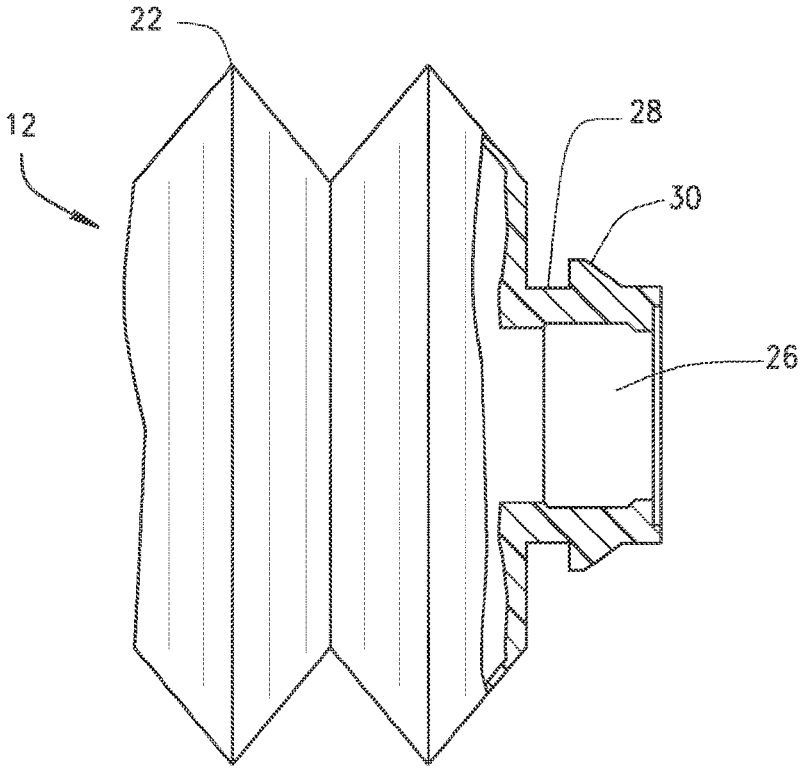
FIG. 12 is a partial cross-sectional view of the neck portion of the bellows-like container of FIG. 11.

As best illustrated in FIGS. 11 and 12, the present bellows-like container 12 includes a container body 20 formed with a plurality of ridges 22 thereby forming its bellows-like shape. The container body 20 includes a closed wall structure 24 at one end portion thereof and an open female cavity 26 at its opposite end portion. The female cavity 26 includes a neck portion 28 having an outer flange 30 associated therewith, the neck portion 28 being sized and shaped so as to cooperatively receive one end portion of the nozzle member 14 as will be hereinafter further explained. The flange 30 extends angularly outward from the neck portion 28 towards the opposite end portion of the container 12 as best shown in FIG. 12. The bellows-like container 12 is fabricated from a non-toxic low density polyethylene (LDPE) material. Although the container 12 can be made in any size, it is typically made so as to hold either 30 milliliters (ML) of a combination of semen, diluent and air (approximately 2.5 ML) for mature cows or 18 ML of a combination of semen, diluent and air (approximately 2.5 ML) for heifers as will be hereinafter further explained. Other sizes are likewise contemplated and anticipated. The ridges 22 as well as the material forming the container 20 make it easier for a technician to grasp and squeeze or compress the container to evacuate the contents of the container during an artificial insemination process. As will be hereinafter further explained, the air trapped in the container 20 during an AI procedure also helps to clear out any residual semen/diluent mix that typically would remain in the pipette after the semen/diluent mix has been injected into the bovine. The overall length of the bellows container 20 is shorter (2.5 inches) than the conventional syringe (8 inches) used with many of the prior art AI devices which makes it much easier to handle for the technician during the breeding process.

Figure 13:
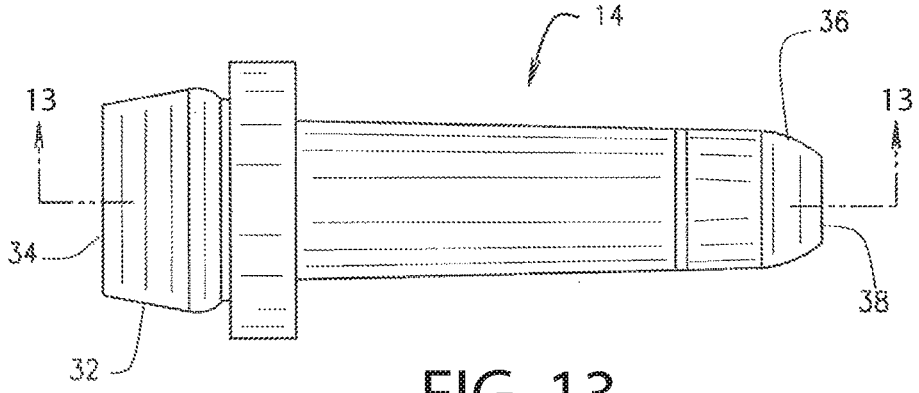
FIG. 13 is a side elevational view of the nozzle member of FIGS. 9 and 10.
Figure 14:
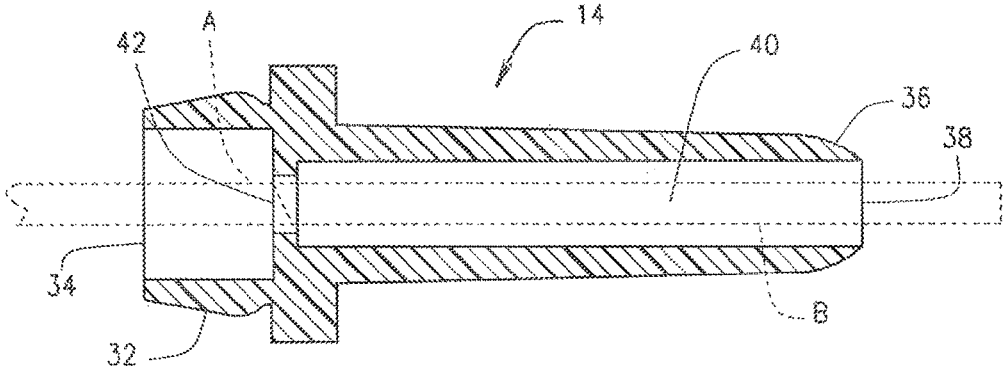
FIG. 14 is a cross-sectional view of FIG. 13 taken along line 13-13.

FIGS. 13 and 14 illustrate one embodiment of a nozzle member 14 which is attached to the female cavity 26 of the bellows-like container 12 illustrated in FIGS. 11 and 12. The nozzle 14 includes a proximal end portion 32 having an opening 34 associated therewith, a terminal end portion 36 having an opening 38 associated therewith, and a passageway 40 extending completely therethrough in communication with the respective openings 34 and 38 so that fluid stored within the bellows-like container 12 can be evacuated from the container 20 through the nozzle passageway 40 as will be hereinafter further explained. The proximal end portion 32 is sized and shaped so as to be inserted within the cavity or opening 26 of container 12 and may include a taper as shown in FIG. 13 to allow for easier insertion of the proximal end portion into the bellows-like container opening 26. This connection can be affected by various methods and elements known by a person of ordinary skill in the art such as by a friction fit or snap-on connection.

Figure 15:
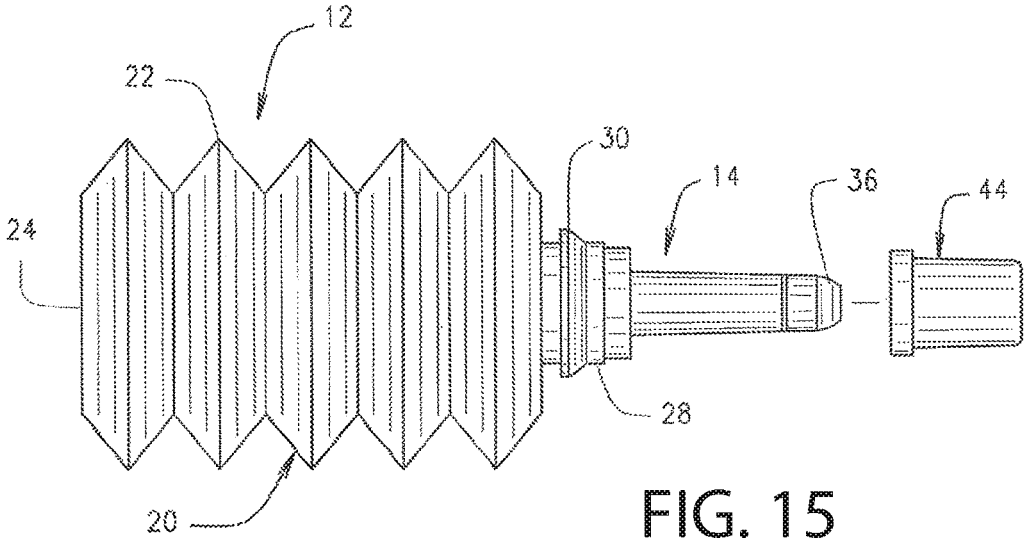
FIG. 15 is a side elevational view of the bellows-like container and nozzle member of FIGS. 9-14 shown in their assembled condition with a cap member positioned for engaging the terminal end portion of the nozzle member.

FIG. 15 illustrates the nozzle member 14 operatively connected to the bellows-like container 12. As best illustrated in FIG. 14, the nozzle member 14 may optionally include a stop member 42 in the form of a grate or other mesh-type member which extends across the proximal opening 34 at a location spaced from its proximal end portion. The stop member 42 includes at least one opening or passageway for allowing the semen contained within a semen straw to follow therethrough as will be hereinafter explained and it functions to stop the end portion of a semen straw inserted within the nozzle 14 such that the semen straw does not make contact with the diluent or other fluid within the container 12 so as not to contaminate such fluid or diluent. In this regard, the terminal end opening 38 as well as nozzle passageway 40 extending therethrough should be of sufficient size so as to accept the insertion of any type of semen straw including both one-half and one-quarter ML semen straws as will be hereinafter further explained. The passageways 38 and 40 have an internal diameter of at least 0.130 inches so as to accommodate both one-half and one-quarter ML semen straws. Once semen from the semen straw is placed into the bellows-like container 12 with the diluent, the semen straw can be easily extracted from the nozzle passageway.

In one embodiment, the nozzle 14 is made from a hard plastic such as a medium density polyethylene material (MDPE) and is approximately 1.080 inches long. The terminal end portion of the nozzle 14 may also include a cap 44 as best shown in FIG. 15 that can be utilized to prevent spillage of any fluid or diluent stored within the container 12 during storage or shipment. The cap 44 can be engaged to the terminal end portion of the nozzle 14 via a self-threading cap, a snap-on mechanism, a friction fit or any other suitable engagement means. Although the bellows-like container 12 is disclosed as having a female cavity 26 associated therewith and the nozzle member 14 is disclosed as having a male proximal end portion 32 associated therewith for insertion into the cavity or opening 26, it is recognized and anticipated that this connection can be reversed with the nozzle member 14 possessing the female connector and the bellows-like container 12 possessing the male connector.

It is also recognized and anticipated that the nozzle member 14 can be made integral with the bellows-like container 12 such that both the container 12 and the nozzle 14 would be a single unit as illustrated in FIG. 15. It is also recognized and anticipated that the optional stop member 42 associated with nozzle member 14 could likewise be incorporated into the container cavity 26 so long as the stop member 42 is positioned and located such that the one end portion of the semen straw inserted through the nozzle passageway 40 cannot come into contact with the diluent stored within the bellows-like container 12.

The stainless steel hollow, elongate pipette 16 is best illustrated in FIGS. 9 and 10 and, in one embodiment, is about 17 inches long with an outer diameter of about 0.135 inches and an inner diameter of about 0.1 inches. Compared to standard artificial insemination pipettes used in the AI industry wherein the outer diameter of such pipettes is typically about 0.185 inches, the much smaller outer diameter of the present pipette gives the breeder a much needed advantage with respect to the passing of the present pipette 16 through the tortuous and difficult-to-navigate cervix of some female bovines, especially young heifers. As best illustrated in FIG. 10, the proximal end portion 46 of pipette 16 may include a collet or one or more raised projections or ridges 48 for reasons which will be hereinafter further explained. The pipette 16 includes a passageway 50 extending completely therethrough from the proximal end 46 and terminates at its closed terminal end 52. The closed terminal end 52 of pipette 16 is smooth and rounded or tapered so as to further facilitate the passing of the pipette 16 through the tortuous and difficult to navigate cervix of some female bovines, especially young heifers. The closed terminal end portion 52 of pipette 16 also allows the AI technician to more easily maneuver and manipulate the end 52 of pipette 16 through the three rings of the cervix; it allows wedging; and it helps prevent fecal matter typically present in the posterior vagina of a female bovine from entering the pipette. At least one and preferably a pair of transverse outlet ports 53 are located near the terminal end 52 of pipette 16 for allowing the insemination solution (semen/diluent) to exit the pipette into the reproductive organs of the bovine.

The present stainless steel or metal pipette 16 has advantages over conventional plastic pipettes in that a metal pipette is much more rigid as compared to a conventional plastic pipette and is less likely to bend, flex or twist during insertion through the cervix of a female bovine and is therefore more easily maneuvered through the three cervical rings and the reproductive organs of the bovine. In addition, a metal pipette has less friction and will more easily glide through the tissue associated with the cervix of a female bovine whereas a plastic pipette has more friction and typically does not glide and can cause inflammation and/or bleeding of the cervix even during the insertion process. In addition, a metal pipette can be machined to a much smaller outside diameter as compared to a plastic pipette and still maintain its rigidity. Still further, the closed smooth, rounded terminal end portion 52 of the present pipette again facilitates insertion of the pipette through the reproductive organs of a female bovine and it likewise helps to prevent any fecal matter that may reside in the posterior vagina of a female bovine from entering the pipette and contaminating the semen/diluent solution passing therethrough. Traditional AI pipettes have an open distal or terminal end which can collect fecal matter and which, when forced to pass the cervical rings, can cause inflammation, bleeding and/or other injury to the cervix during the insertion process. In this regard, the transverse or side positioned outlet ports 53 are less likely to pick up and carry fecal matter and fecal bacteria during the insertion process. The smaller outside diameter associated with the present pipette further facilitates the insertion process. Although a stainless steel pipette is presently preferred, it is recognized and anticipated that any metal yielding the above-advantages can be used in fabricating the present pipette 16.

The proximal end 46 of the pipette 16 is connected to the terminal end portion 36 of the nozzle member 14 through the use of a flexible tubing 18. This flexible tubing can be made from silicone and it can have a dimension of about 1.10 inches in length with an inner diameter of about 3/16 inches and an outer diameter of about 5/16 inches and with a wall thickness of about 1/16 inches. The flexible tubing 18 includes a passageway 54 extending completely therethrough. The connection of both opposite end portions of the flexible tubing 18 with the respective end portions of the nozzle member 14 and pipette 16 can be affected by various methods and elements known by a person of ordinary skill in the art. In one embodiment, the respective opposite end portions of the flexible tubing 18 extend over the distal opening 38 of the nozzle member 14 and the inner diameter of the tubing 18 is sized such that it results in a friction fit with the terminal end portion 36 of nozzle member 14. In similar fashion, the opposite end portion of the flexible tubing 18 extends over the proximal end 46 of the pipette 16. Again, this connection can be affected by various methods and elements known by a person of ordinary skill in the art.

In the particular embodiment illustrated in FIGS. 9 and 10, the flexible tubing 18 fits over a collet 48 located near the proximal end portion 46 of the pipette 16. The collet 48 could be one or more ridges extending either partially or fully around the outer-surface of the proximal end portion 46 of pipette 16 as best illustrated in FIG. 10, or the collet 48 could be one or more raised projections or bumps positioned on the outer surface of the pipette end portion 46, or any other surface feature or texture which will improve the attachment of the flexible tube 18 to the proximal end portion 46 of the pipette 16. In one embodiment, the collet 48 can be made of brass having an overall length of about 0.25 inches and having an outer diameter of about 0.25 inches. The presence of the collet 48, or one or more projections or ridges, on the proximal end 46 of the metal pipette 16 provides a tighter friction fit when the flexible tubing 18 is maneuvered over the collet 48. In another embodiment, a zip tie (not shown) can be used to tie and connect the opposite end portions of the flexible tubing 18 to the respective end portions of the nozzle member 14 and pipette 16. It is also preferred that the terminal end portion 36 of the nozzle member 14 lie adjacent to the proximal end portion 46 of the pipette 16 when the members 14 and 16 are connected together with the flexible tube 18 thereby ensuring that all, or at least most, of the semen/diluent solution passes from the nozzle member 14 to the pipette 16. In one embodiment, the flexible tubing is made from silicone and it is a cured silicone tubing capable of withstanding autoclave temperatures in the neighborhood of 250° F. Although other flexible tubing may be utilized, whatever material is selected, it should be able to withstand normal autoclave temperatures without turning opaque or losing its flexibility and without expanding its outer diameter so as to lose its tight fit on the proximal end of the pipette.

In one embodiment, the bellows-like container has a length from the end wall 24 to the opening 26 of about 2.281 inches (57.95 mm), and the diameter of the bellows-like container 12 at a ridge 22 is about 1.406 inches (35.72 mm). The opening 26 has a diameter of about 0.310 inches (7.87 mm). The length of the neck portion 28 is about 0.281 inches (7.1 mm). The flange is located about 0.187 inches from the terminal end of opening 26 and extends angularly outward from the neck portion 28 at an angle of about 60°. The length between the tip of a ridge 22 to a corresponding valley as measured longitudinally along the length of container 12 is about 0.200 inches (5.08 mm) and the angle formed between two adjacent ridge tips is about 77° when the bellows-like container is depressed or compressed. The one end portion 24 of the bellows-like container 12 may also include an indention towards the inner cavity of the bellows-like container, the depth of the indention measured longitudinally being about 0.125 inches (3.18 mm).

In one embodiment, the diameter of the proximal opening 34 of the nozzle member 14 may be larger than the diameter of the terminal opening 38.

A method of artificially inseminating a female bovine using the present apparatus 10 includes the following steps. First of all, before or after the nozzle 14 is attached to the bellows-like container 12, a diluent is deposited within the bellows-like container 12. The technician may select any of several known diluents for use in the present method including buffered saline, various chemically available embryo flush solutions, various commercially available extenders used in cryopreservation of semen and other products or other solutions not identified herein may also prove useful provided they have a proper pH, osmolarity, and are properly buffered to dilute and support the life of the sperm. The pH of the diluent is typically about 7 to about 7.4 and the osmolarity is typically about 280 to about 300 mOsm/L.

Various commercially available embryo flush solutions that may be suitable in the practice of the present invention include:

a) Syngro Holding Medium, Vigro Complete Flush Solution, Vigro Holding Plus, Vigro Rinsing Solution all available from Vetoquinol, Fort Worth, Tex. USA.

b) emP3 Complete Flush and emP3 Holding Solution both available from Partnar Animal Health of Port Huron, Mich., (www.partnaranimalhealth.com).

c) Emcare Complete Ultra Flush Medium, available from ICPbio International Ltd. of Auckland, New Zealand, (www.icpbio.com).

Some extenders used in cryopreservation of bull semen may be used as a diluent in the practice of the present invention. Other semen extenders such as Biladyl®, Fraction A, also from Minitube of America in Verona, Wis. (www.minitube.com) does not contain a cryoprotectant or glycerol and may be suitable for use in the practice of this invention. The present invention may be practiced with any diluent that is not toxic to bovine sperm or the bovine's reproductive system.

Once the diluent is stored within the bellows-like container 12, the nozzle member 14, if not already attached to the container 12, is thereafter inserted into the female cavity 26 for attachment to the container 12. As previously explained, the bellows-like container 12 typically comes in various sizes and can be fabricated in any size. Typically, a 30 ML container is utilized for mature cows and an 18 ML container is utilized for smaller bovines such as heifers. Typically, a ½ or ¼ ML semen straw is used within a 30 ML or an 18 ML container. If a 30 ML container is used, typically such container will include 27 ML of diluent, ½ or ¼ ML of semen and 2½ or 2¾ ML of air. If an 18 ML container is utilized, typically such container will include 15 ML of diluent, ½ or ¼ ML of semen and 2½ or 2¾ ML of air.

Once the diluent is transferred to the bellows-like container 12, the appropriate sized semen straw is selected and inserted into the terminal end portion of the nozzle member 14. Typically, the semen straw is kept frozen until ready for use. The semen straw includes a cotton plug on one end and a crimp on the other end. The semen is frozen between the crimped end and the cotton plugged end of the semen straw. Prior to inserting the semen straw into the nozzle member 14, a technician will warm the frozen semen straw in warm water at a temperature of about 95° F. to about 98° F. for at least about 30 seconds. Once the semen is thawed, the crimped end of the semen straw is cut and the cut end is placed within the nozzle openings 38 and 40. In one embodiment, the nozzle member 14 and/or the bellows-like container 12 will not include the optional stop member 42. In this embodiment, the crimped end of the semen straw such as semen straw A illustrated in FIG. 14 will have to be sanitized with a moist alcohol wipe prior to cutting the crimped end of the straw. Once the crimped end has been sanitized, the crimped end of the semen straw A is cut and inserted into the nozzle opening 38 and the semen straw is pushed through the nozzle 14 so that the cut end of the semen straw A will rest against the closed end wall 24 of the bellows-like container. In this embodiment, the bottom of the bellows-like container functions as a stop member. Once so positioned, the cotton plug is then pushed along the length of the semen straw A with a stylet or other appropriate instrument thereby forcing the semen through the straw into the diluent contained with the container 12. In this regard, it is advantageous to cut the semen straw at an angle, preferably at an angle of about 45°, so that the evacuation of the semen from the semen straw will flow easily into the bottom of the bellows-like container 12. If, for example, the crimped end of the semen straw is cut transversely across such end portion at a 90° angle, when the cut end of the semen straw is positioned against the closed wall end 24 of the bellows-like container, the wall 24 will interfere with and block the steady flow of semen from the straw into the container 12. As a result, an angular cut is preferred although not required. If a 90° cut is utilized, the cut end of the semen straw can be spaced slightly from the closed end wall 24 of the bellows-like container when that semen straw is positioned within such container.

In another embodiment where stop member 42 is utilized within either the nozzle 14, or within the container cavity 26, although preferred, there will be no need to sanitize the crimped end of the straw prior to cutting such crimped end because the crimped end of the semen straw will be positioned within the nozzle opening 38 such that it will make contact with and abut the stop member 42 within the nozzle member 14. As such, the cut end of the semen straw such as semen straw B likewise illustrated in FIG. 14 will not make contact with the diluent and will not contaminate such diluent. Once so positioned, the cotton plug is then again pushed along the length of the semen straw B with a stylette or other appropriate instrument so as to force the semen to drain from the straw into the diluent contained within the container 12. The stop member 42 also stops the progression of the cotton plug as it pushes the semen through the semen straw B. Whether the optional stop member 42 is utilized or not, once the semen is evacuated into the diluent contained within the bellows-like container 12, gently swirling of the bellows-like container will mix the semen with the diluent.

In an alternative method for evacuating the semen associated with a semen straw into the diluent, the cotton plug associated with a typical semen straw can be removed by cutting and the semen can be allowed to drain by gravity into the diluent via the container cavity 26.

Once the semen is thoroughly mixed with the diluent within the bellows-like container 12, one end portion of the flexible tubing 18 is positioned over the terminal end portion 36 of the nozzle member 14. In similar fashion, the opposite end portion of the flexible tubing is then positioned over the proximal end 46 of the pipette 16 and over the collet 48, if the collet is used, so as to couple the pipette 16 with the container 12 and nozzle 14. The present AI apparatus 10 is now fully assembled and is fully operable for insertion into the reproductive organs of a female bovine and for evacuating the semen/diluent mix into the bovine.

Because the metal pipette 16 is rigid and much smaller than conventional AI pipettes presently in use, manipulation of the pipette 16 into the bovine's vagina, past the three rings of the cervix to the body of the uterus is more easily accomplished, particularly when inserting the pipette 16 into the reproductive organs of a heifer. The present stainless steel pipette 16 is easier to insert and glides through the cervix of even a heifer due to its rigidity and size as compared to conventional plastic pipettes. The metal pipette 16 with its closed, smooth, rounded terminal end 52 acts as an atraumatic aid in passing through the tortuous cervix. Once the pipette 16 is properly inserted within a bovine, a technician will rotate the bellows-like container 12 into a vertical position before depressing or compressing the bellows container 12 to flush or evacuate the semen/diluent mix through the apparatus 10 to the uterus of the bovine. When the bellows container 12 is rotated into a vertical position, the semen/diluent is moved towards the opening 26 of the container preparatory to evacuating the semen/diluent mix through the nozzle member 14, the tube 18 and the pipette 16. The air trapped within the bellows container, when in its vertical position, moves to the top of the end wall 24 of the container 12 and facilitates the clearing of the line and the discharge of the semen/diluent solution through the nozzle 14, the flexible tubing 18 and the pipette 16 when the container 12 is depressed or compressed.

A typical pipette will hold about 2.5 ML of the semen/diluent solution along its length. Trapping about 2.5 ML of air at the top of the vertically oriented container 12 is just enough air to clear the pipette of any residual semen/diluent mix. The 2.5 ML of air is the last thing to exit the bellows-like container 12 thus pushing and clearing the nozzle 14, flexible tube 18 and pipette 16 of any residual mix. If this air was not present in the system, we would lose the volume of semen/diluent mix which would remain in the pipette. This is approximately 2.5 ML or 8% of the total volume. The flexible tubing 18 allows the bellows container 12 to be rotated into its vertical position before flushing the semen/diluent mix through the present apparatus 10. The technician will hold the bellows container 12 depressed until the semen/diluent is deposited within the reproductive organs of the bovine and until the pipette 16 is pulled out of the bovine's cervix.

The present apparatus 10 can also be provided in kit form wherein the various components 12, 14, 16 and 18 can be packaged for use by an AI technician. In one embodiment, the kit can include each of the four components, namely, the bellows-like container 12, the nozzle member 14, the metal pipette 16, and the flexible tubing 18 in a packaged container for use and assembly by the AI technician. In another embodiment, a prescribed amount of diluent can be pre-stored within the bellows-like container 12 and the nozzle member 14 can be attached thereto, or integrally formed therewith, such that cap member 44 can be engaged with the terminal end portion 36 of the nozzle member 14 so as to prevent spillage of the diluent within the container 12 during storage and shipment as well as possible contamination. The container 12, nozzle 14 and diluent stored within the container 12 along with the cap member 44 can be packaged in a suitable arrangement along with the pipette 16 and flexible tubing 18 for use by an AI technician. In another embodiment, the one end portion of the flexible tubing 18 can be pre-attached to the proximal end portion 46 of the metal pipette 16 and provided to the AI technician along with the container 12, nozzle member 14, cap 44 and diluent stored within the container 12. This kit arrangement, if stored properly, will speed up the artificial insemination process when the AI technician is ready to artificially inseminate a female bovine. The pipette 16 may include a collet 48 located at its proximal end portion 46.

In another kit embodiment, it is recognized and anticipated that the flexible tubing 18 will be placed over the collet 48 or other projection(s) or ridge(s) on the proximal end 46 of the metal pipette 16 before being placed in the kit package. This combination of the flexible tubing 18 already attached to the proximal end 46 of the pipette 16 will then be autoclaved for sanitation purposes and will be placed in the kit ready for use by the AI technician. The bellows-like container 12 will then be pre-filled with diluent and the nozzle 14 will be snapped into place or otherwise engaged with the bellows-like container 12 with a protective cap 44 engaged with the terminal end 36 of the nozzle 14. The combination of container 12 with the diluent pre-stored therewithin, nozzle 14 and cap 44 will then be placed in the kit along with the combined autoclaved pipette 16 and flexible tubing 18. This kit will then contain basically two components as just described. Once a semen straw is thawed and mixed with the diluent in the bellows-like container as previously described, the nozzle will be pushed into the open end of the flexible tubing 18 creating a tight friction attachment therebetween and the AI technician will now be ready to artificially inseminate a female bovine. Other kit arrangements are likewise envisioned and anticipated. Kits can be packaged specifically for use on mature female bovine and kits can be packaged for use on heifers.

Moreover, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

Lastly, all defined terms used in the application are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. An apparatus for artificial insemination, comprising:

a nozzle member having a proximal end portion, a terminal end portion, and a passageway extending therebetween, said proximal end portion configured for engagement with a container, said passageway configured to couple to a semen straw;

a straight, rigid pipette having a proximal end portion, a terminal end portion, a passageway extending therebetween, and at least one outlet port proximate said terminal end portion thereof; and a flexible tube member having a passageway extending therethrough, one end portion of said tube member being engageable with said terminal end portion of said nozzle member, and an opposite end portion of said tube member being engageable with said proximal end portion of said pipette;

said nozzle member, said pipette, and said tube member forming a straight passageway from said container to said outlet port when said tube member is engaged with said nozzle member and said pipette.

2. The apparatus of claim 1, wherein said opposite end portion of said tube member extends over said proximal end portion of said pipette when said opposite end portion of said tube member is engaged with said proximal end portion of said pipette.

3. The apparatus of claim 1, wherein an outer diameter of said pipette is about 0.134 inches.

4. The apparatus of claim 1, wherein said terminal end portion of said pipette is smooth and rounded.

5. An apparatus for artificial insemination, comprising:

a nozzle member having a proximal end portion, a terminal end portion, and a passageway extending therebetween, said proximal end portion configured for engagement with a container, said passageway configured to couple to a semen straw;

a straight, rigid pipette having a proximal end portion, a terminal end portion, a passageway extending therebetween, and at least one outlet port proximate said terminal end portion thereof; and a flexible tube member having a passageway extending therethrough, one end portion of said tube member being engageable with said terminal end portion of said nozzle member, and an opposite end portion of said tube member being engageable with said proximal end portion of said pipette.

6. A method for artificial insemination, comprising:

transferring semen from a semen straw to a container containing an amount of diluent to form an insemination solution within said container;

coupling a proximal end of a rigid pipette to said container;

inserting a distal end of said pipette into a reproductive system; and transferring at least a portion of said insemination solution from said container to said reproductive system.

7. The method of claim 6, further comprising uncoupling said semen straw from said container prior to said artificial insemination.

* * * * *